United States Patent [19]

Larsen

[11] Patent Number: 4,523,534

[45] Date of Patent: Jun. 18, 1985

[54] LOOPTAKER MECHANISM

[75] Inventor: Leif U. Larsen, Huskvarna, Sweden

[73] Assignee: Husqvarna Aktiebolag, Huskvarna, Sweden

[21] Appl. No.: 476,537

[22] Filed: Mar. 18, 1983

[30] Foreign Application Priority Data

Mar. 26, 1982 [SE] Sweden ..... 8201950

[51] Int. Cl.[3] ..... D05B 57/08; D05B 57/26

[52] U.S. Cl. ..... 112/231

[58] Field of Search ..... 112/181, 182, 184, 228, 112/229, 230, 231

[56] References Cited

U.S. PATENT DOCUMENTS

| | | | |
|---|---|---|---|
| 1,474,138 | 11/1923 | Bell et al. | 112/181 |
| 1,484,624 | 2/1924 | Cooper | 112/228 |
| 2,148,385 | 2/1939 | Waterman | 112/184 |
| 3,146,744 | 9/1964 | Bradshaw | 112/232 |
| 3,343,510 | 9/1967 | Attwood et al. | 112/228 |
| 4,292,906 | 10/1981 | Johnson | 112/184 |

*Primary Examiner*—Wm. Carter Reynolds
*Attorney, Agent, or Firm*—Alfred E. Miller

[57] ABSTRACT

A rotating sewing machine hook (1) with a horizontal shaft in which the axis of the under thread bobbin (15) forms an angle (a>0) to the hook shaft in a horizontal plan, whereby the width of the bobbin can be increased without the use of thread guide plates, because the inclination of the bobbin in the bobbin holder (6) facilitate the passage of the upper thread around the bobbin holder.

7 Claims, 6 Drawing Figures

Fig. 1
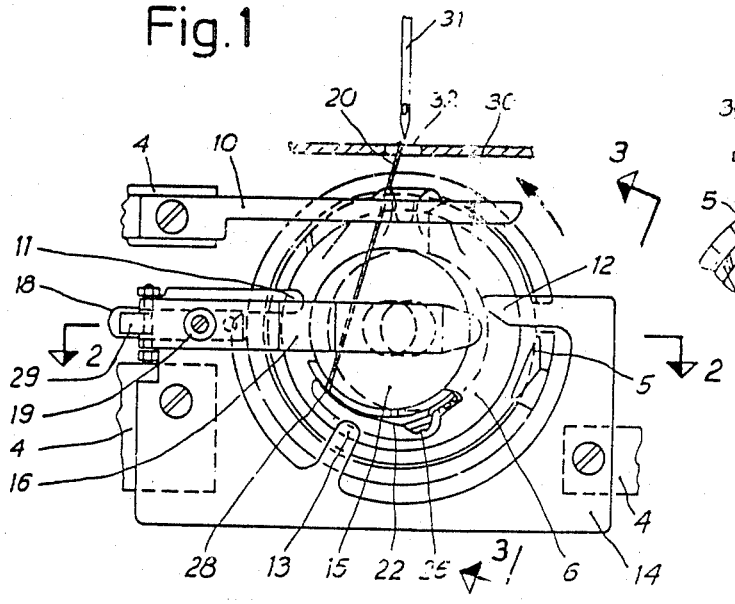
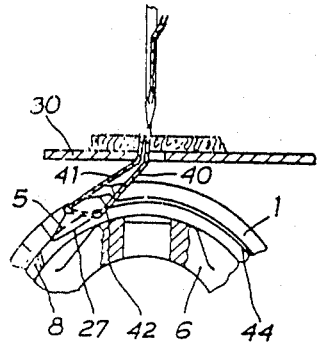
Fig. 6
Fig. 2
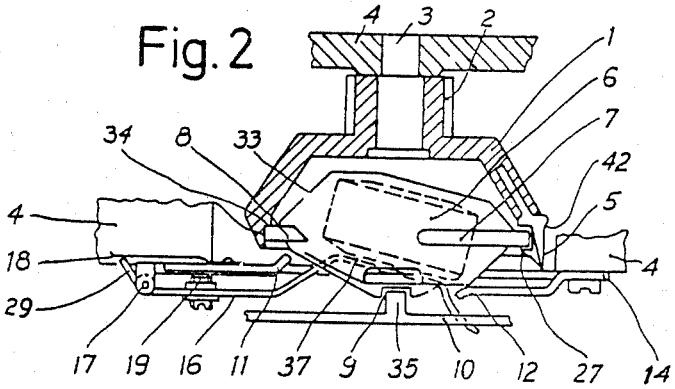
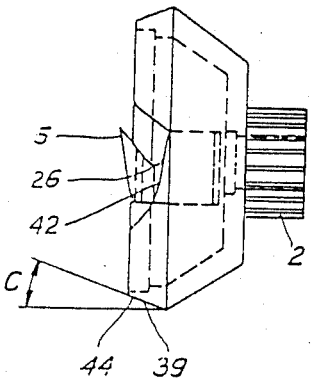
Fig. 3
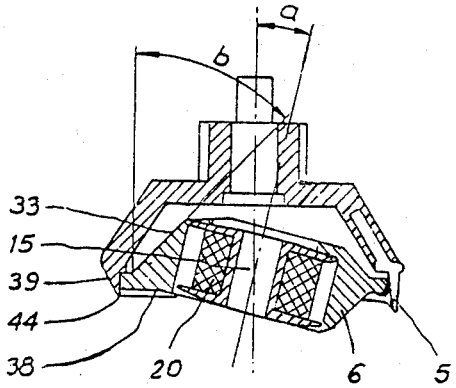
Fig. 4
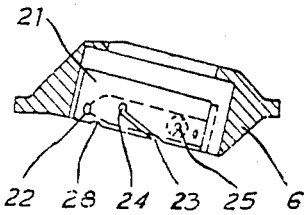
Fig. 5

LOOPTAKER MECHANISM

The present invention relates to a looptaker mechanism in a zig-zag sewing machine for domestic use.

A conventional looptaker mechanism is comprised of a journalled hook ring with a hook tip rotatable around a shaft driving the hook from a transmission, and a bobbin case with an underthread bobbin retained in the hook ring by a releasable holder. Hookers with horizontal shaft are suitably positioned as close to the stitch plate as possible and it is therefore a rule that the needle with the upper thread can pass at the side of the bobbin on its way to the hook center when the stitch is formed. The bobbin case must be provided with a so-called needle shield and an arrangement preventing the rotation of the case when it its subjected to friction against the rotating hook. These arrangements at a conventional construction make it necessary to make the bobbin rather thin or to provide the hook with a thread guide plate which forces the upper thread over the bobbin case and the bobbin. The plate slides with a great speed against the upper thread and must be hardened and polished in order to minimize the friction and tear and wear. It is thus impossible to produce such hook ring in plastics which would otherwise be proper in order to make the hook cheap.

In the arrangement in a looptaker mechanism according to the invention the thread guide plate can be omitted but a normal length of the bobbin can still be used, the hook ring can be produced in one piece of plastics with a hook tip of steel embedded therein. These improved properties in a looptaker mechanism with a rotating hook are obtained due to a simplification such that the guiding of the upper thread loop around the bobbin case is facilitated by the fact that the axis of the under thread bobbin forms an angle greater than zero to the shaft of the hook ring.

An embodiment of a looptaker mechanism according to the invention is described in the following paragraphs with reference to the accompanying drawing which shows in FIG. 1 the looptaker mechanism in vertical projection, FIG. 2 a horizontal cross section at 2—2 through the mechanism, FIG. 3 a hook ring with a pinion in a side projection from the arrows 3—3 in FIG. 1, FIG. 4 a cross section of the hook ring, the bobbin case and the bobbin, FIG. 5 a cross section of the bobbin case and the thread tensioner and FIG. 6 a part of the hook ring and the needle in vertical projection.

The looptaker mechanism has a rotating hook ring 1 which is driven via a toothed wheel 2 in the direction of the arrow and is journalled on a shaft 3 (FIG. 2) fixed in a portion 4 of the sewing machine body. The hook ring has a hook tip 5 which takes the upper thread loop, and it also encloses a bobbin holder 6 provided with a divided bearing flange 7 which is provided with a tip 8. The bobbin holder is prevented from rotating by a retaining arm 10 and is kept in position in the hook by three fingers 11, 12, 13 on a lid 14 which is fastened to the body by screws. Between the fingers 11, 12, 13 and the bobbin holder there is a play so that the upper thread loop can pass therebetween, when it is conducted around the bobbin holder which encloses an under thread bobbin 15. On the lid 14 is a latch 16 (FIGS. 1 and 2) fastened by means of a hinge 17 for keeping the bobbin in its position in the holder by means of a spring 18, the spring holding the latch 16 against the bobbin by applying pressure to an arm 29 so that an adjusting screw 19 abuts the lid 14. The bobbin holder is provided with a thread tensioner 21 (FIG. 5) for the under thread 20 consisting of a leaf spring 22 above a slot 23 having an end 24 guiding the under thread, moreover a screw 25 by which the under thread tension can be adjusted.

In order to pull out the upper thread since it is taken by the tip 5, the tip is made to have an angle with a side surface 26 below an edge 27. In order to guide the under thread there is a slot 28 in the bobbin holder below the latch 16 up to the stitch plate 30 (FIG. 1). Above the stitch plate 30 the sewing machine needle 31 is shown which after the penetration of the hole 32 in the plate and return from the lowest position forms a loop of the upper thread. During the motion of the hook the upper thread passes over the rear surface 33 of the bobbin holder, a countersunk bearing surface 34 in the hook, a locking knob 35 at the arm 10, a fissure 37 between the bobbin 15 and the latch 16, a portion of the front side 38 of the bobbin holder and a bevelled edge 39 of the hook ring. The surface 34 of the hook ring extends perpendicular to the axis of shaft 3.

Thus, when the tip 5 has taken the upper thread from the needle 31 (FIG. 6) one part 41 of the loop passes from the seam in the cloth below the edge 27 of the tip and therefrom as the other part 40 of the loop up to the needle eye. When the hook tip passes the tip 8 (FIGS. 2 and 6) this latter will guide the loop in below the hook tip, whereby the part 40 is guided over the rear surface 33 of the bobbin holder while the part 41 by another edge 42 on the hook ring (FIG. 2 and 3) is guided on the bevelled surface 39 and during the rotation of the ring is forced over a brim 44 of the hook ring as the surface 39 forms an angle c to the hook shaft. The upper thread loop is forced in this way through the interruption of the bearing flange 7 and the tip 8 over the stationary rear surface 33 of the bobbin holder, passes in the fissure between the flange 7 and the bearing surface 34 and over the front surface 38 in the fissure 37 between the bobbin 15 and the latch 16 and further through the fissure 9 at the knob 35 to finally form a stitch when it pulls the under thread up to the cloth.

According to the present invention idea the bobbin 15 is positioned in the holder with an angle a between the axis of the bobbin and the hook shaft, the surface 38 of the bobbin holder is then somewhat below the brim 44 of the hook ring so that the part 41 of the thread easily moves over the bobbin holder. The inclined position of the bobbin is accompanied by an increase in the angle b (FIG. 4) which is the inclination of the bevelled surface 33 on the rear side of the bobbin holder, the angle b being greater than in the case when the bobbin has a common axis with the hook. The greater angle b provides a greater slope for the part 40 of the thread when it passes over the rear surface than what is the case in a conventional mechanism. As seen in FIGS. 1 and 2, the axis of the bobbin 15 is parallel to the stitch plate 30 and hence parallel to planes normal to the needle 31. In other words, as seen more clearly in FIG. 2, the faces of the bobbin 15 are in planes parallel to the needle.

The embodiment now described is an example how the invention can be practised. However, it may also be used on other types of hooks than the described one.

For instance, the bobbin holder may be replaced or completed with a bobbin can provided with thread tensioner for the bobbin thread. The lid 14 may be substituted by guiding ribs on the hook which holds the bobbin in a known manner. Such variations are considered parts of the inventive idea which is defined in the following claims.

I claim:

1. In a looptaker mechanism for a zig-zag sewing machine having a hook ring supported on a shaft a sewing machine needle having an eye, the hook ring having a hook tip mounted to cooperate with the sewing machine needle, the hook tip being arranged to take an upper thread from the needle, and a bobbin holder for an under thread bobbin journalled in the hook ring; the improvement wherein the bobbin is mounted in the bobbin holder with its axis forming an angle greater than 0 to the axis of said shaft, said hook ring having a bearing surface in a plane perpendicular to said shaft, said bobbin holder having a bearing flange journalled in said bearing surface, the axis of said bobbin being parallel to a plane normal to said needle.

2. The looptaker mechanism of claim 1 wherein said bearing flange has an interruption at a point at its periphery, and a tip at said interruption positioned with respect to the hook tip to guide a first part of the upper thread taken by the hook tip on to the rear surface of the bobbin holder.

3. The looptaker mechanism of claim 2 wherein an edge at said hook tip forms a guide for another part of said upper thread, thereby guiding it over the front of said bobbin holder.

4. The looptaker mechanism of claim 3 wherein said first part of said thread is led through the eye of said needle.

5. The looptaker mechanism of claim 2 wherein the back of said bobbin holder has a beveled side surface behind said tip, said bevel side surface forming an angle with respect to said shaft that is greater than the angle between the axis of said bobbin and said shaft.

6. The looptaker mechanism of claim 1 wherein the front of said bobbin holder is positioned partly below the brim of said hook ring.

7. In a looptaker mechanism for a zig-zag sewing machine having a hook ring supported on a shaft, the hook ring having a hook tip mounted to cooperate with the sewing machine needle, and a bobbin holder for an under thread bobbin journalled in said hook ring; the improvement wherein the bobbin is mounted in said bobbin holder and is positioned with its axis forming an angle greater than 0 to the shaft of said hook ring, the faces of said bobbin extending in planes parallel to said needle.

* * * * *